US008876418B2

(12) United States Patent
Kagami et al.

(10) Patent No.: US 8,876,418 B2
(45) Date of Patent: Nov. 4, 2014

(54) PRINTING SYSTEM, SHEET PROCESSING SYSTEM, AND SHEET-PATH SWITCHING APPARATUS

(75) Inventors: Yuji Kagami, Kawasaki (JP); Takashi Nojima, Tokyo (JP); Shinya Asano, Tokyo (JP); Hideo Sugimura, Tokyo (JP); Hiroyuki Kinoshita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 13/051,704

(22) Filed: Mar. 18, 2011

(65) Prior Publication Data

US 2011/0243634 A1 Oct. 6, 2011

(30) Foreign Application Priority Data

Mar. 31, 2010 (JP) ..... PCT/JP2010/055790

(51) Int. Cl.

| | |
|---|---|
| ***B65H 23/32*** | (2006.01) |
| ***B41F 13/06*** | (2006.01) |
| ***B41J 15/04*** | (2006.01) |
| ***B41J 3/60*** | (2006.01) |
| ***B41J 3/54*** | (2006.01) |

(52) U.S. Cl.

CPC .. *B41J 3/60* (2013.01); *B41J 15/04* (2013.01); *B41J 3/543* (2013.01); *B65H 23/32* (2013.01)

USPC ..... 400/607; 400/612; 101/222

(58) Field of Classification Search

USPC ..... 400/611, 609, 612, 607, 608.4; 399/384; 101/480, 222, 223, 257, 230, 101/220, 221; 242/615.21, 615.12; 226/196.1

IPC ... B65H 20/24,23/32; B41F 13/06, 13/02; B41J 15/18, 15/22

See application file for complete search history.

(56) References Cited

U.S. PATENT DOCUMENTS

| | | | | |
|---|---|---|---|---|
| 5,647,582 | A * | 7/1997 | Shiba | 270/8 |
| 6,120,142 | A * | 9/2000 | Eltgen et al. | 347/104 |
| 6,615,717 | B1 * | 9/2003 | Perdu | 101/223 |
| 2002/0195008 | A1 | 12/2002 | Perdu | |
| 2003/0167943 | A1 * | 9/2003 | Izawa et al. | 101/223 |

FOREIGN PATENT DOCUMENTS

| | | | | |
|---|---|---|---|---|
| CN | 001916783 | A | 2/2007 | |
| JP | 49-060801 | U | 5/1974 | |
| JP | 58-113063 | A | 7/1983 | |
| JP | 2-138063 | A | 5/1990 | |
| JP | 10087136 | A * | 4/1998 | B65H 23/32 |
| JP | 2000-019791 | A | 1/2000 | |

(Continued)

*Primary Examiner* — Daniel J Colilla
*Assistant Examiner* — Ruben Parco, Jr.
(74) *Attorney, Agent, or Firm* — Canon USA Inc. IP Division

(57) ABSTRACT

In a printing system capable of selectively performing duplex printing and simplex printing, a switching unit switches a sheet travel path between a first path and a second path parallel to each other, and reverses the sides of a sheet that passes along the first path. In the duplex printing, a sheet is printed on a first side by a first printing apparatus, reversed by the switching unit, and printed on a second side reverse of the first side by a second printing apparatus. In the simplex printing, only one side of a sheet is printed by the first printing apparatus and/or second printing apparatus. First and second input units introduce sheets into the first and second paths, respectively; and first and second output units receive printed sheets that have traveled along the first and/or second paths.

12 Claims, 10 Drawing Sheets

(56) References Cited

FOREIGN PATENT DOCUMENTS

| | | | |
|---|---|---|---|
| JP | 2003-260779 | A | 9/2003 |
| JP | 2007-050600 | A | 3/2007 |
| JP | 3944834 | B2 | 7/2007 |

* cited by examiner

PRINTING SYSTEM, SHEET PROCESSING SYSTEM, AND SHEET-PATH SWITCHING APPARATUS

TECHNICAL FIELD

The present invention relates to systems capable of performing processing, such as printing, on sheets at high speeds.

BACKGROUND ART

A printing system is known in which a plurality of printing apparatuses are simultaneously operated in combination to increase printing productivity (i.e., print output per unit time). For example, a printing system disclosed in Patent Literature 1 (PTL 1) has a two-line configuration composed of two simplex printing apparatuses that selectively perform duplex printing and simplex printing on a continuous sheet or roll of printing material.

CITATION LIST

Patent Literature

PTL 1 Japanese Patent No. 3944834

In the entire process within a printing factory, there are various processing steps before and after a printing step. Before the printing step, there may be a pre-coating step which involves applying a coating to a print side of a sheet. After the printing step, there may be a cutting step which involves cutting a printed and wound roll or a folding step for bookbinding. From the point of view of passing operations for passing the roll of printing material from and to processing apparatuses used in steps before and after the printing step, the printing system described in PTL 1 has the following problems to be solved.

(1) A heavy workload is placed on workers in a loading operation for loading a roll from a pre-processing apparatus into a printing line (i.e., inputting a sheet into the printing line) and in an unloading operation for unloading and passing a printed roll to a post-processing apparatus (i.e., outputting a sheet from the printing line). In the layout of PTL 1 (either in FIG. 1 or FIG. 2), two input units for loading new rolls into respective two lines are disposed separately from each other. When two input units are separate, the distance that rolls are carried from a pre-processing apparatus in a loading operation is large. At the same time, two output units for unloading rolls printed in the respective two lines are disposed separately from each other. When two output units are separate, the rolls must be carried a relatively large distance from either of the output units to a post-processing apparatus. In a large printing system, the length of lines can be over 10 m, and the weight of rolls to be used can be as heavy as several tens of kilograms. Therefore, an increase in carrying distance directly leads to an increased workload placed on workers.

(2) Installation of printing lines requires a large floor area in a printing facility. In the layout of PTL 1 (as illustrated in FIG. 1 or FIG. 2 of PTL 1), two input units for loading rolls of printing material are separate. This means that each of the two input units requires a work space for a worker therearound. Similarly, each of two output units for unloading the rolls requires a work space therearound. That is, a work space is required at a total of four locations. Since a large floor area is thus necessary, it is difficult to realize a highly-integrated layout.

(3) It is difficult to flexibly accommodate addition of printing lines. When the layout of PTL 1 (either in FIG. 1 or FIG. 2) is extended to install additional lines, the locations of input units and output units are further separated randomly. Since some of the input units or output units are surrounded by apparatuses, a worker is unable to load a roll from a pre-processing apparatus or unload a roll to a post-processing apparatus. This means that it is practically impossible to install additional lines.

The present invention has been made on recognition of the problems described above. An object of the present invention is to provide a printing system and a sheet processing system not specifically designed for printing which are capable of solving at least one of the problems described above.

SUMMARY OF INVENTION

A printing system according to the present invention is capable of selectively performing duplex printing and simplex printing. The printing system includes a first printing apparatus and a second printing apparatus sequentially disposed along a first path; a first input unit configured to introduce a sheet into the first path; a second input unit, disposed near the first input unit, configured to introduce a sheet into a second path parallel to the first path; a first output unit to which a sheet that has traveled along the first path is output; a second output unit, disposed near the first output unit, to which a sheet that has traveled along the second path is output; and a switching unit capable of switching a sheet travel path between the first path and the second path, and capable of reversing the sides of a sheet that passes along the first path. In the duplex printing, the sheet introduced from the first input unit into the first path is printed on a first side by the first printing apparatus, reversed by the switching unit, introduced into the second printing apparatus, printed on a second side reverse of the first side by the second printing apparatus, and output to the first output unit. In the simplex printing, the sheet introduced from the first input unit into the first path is printed by the first printing apparatus, diverted into the second path by the switching unit, and output to the second output unit, or the sheet introduced from the second input unit into the second path is diverted into the first path by the switching unit, introduced into the second printing apparatus, printed by the second printing apparatus, and output to the first output unit.

Further features of the present invention will become apparent from the following description of exemplary embodiments with reference to the attached drawings.

DESCRIPTION OF EMBODIMENTS

The present invention is applicable to a printing system that performs print processing on continuous sheets. The present invention is also applicable to a sheet processing system that performs various types of processing (e.g., recording, machining, coating, irradiation, reading, and inspection) on continuous sheets and supports both duplex processing and simplex processing. Hereinafter, a description will be given of an example in which the present invention is applied to a printing system for inkjet printing apparatuses. In the present specification, the term "sheet" refers to a flexible continuous sheet item of any material. Examples of the sheet include a paper sheet, a plastic sheet, a film, a web, a metal sheet, and a flexible substrate. In the following description, a sheet will be referred to as a continuous sheet or simply as a sheet; alternatively, a continuous sheet may also be referred to as a "roll". Thus, the term "roll of sheets" or simply "roll" is used to denote a round shape formed by a series of concentric circles obtained by winding a continuous sheet or several individual sheets.

Figure 1:
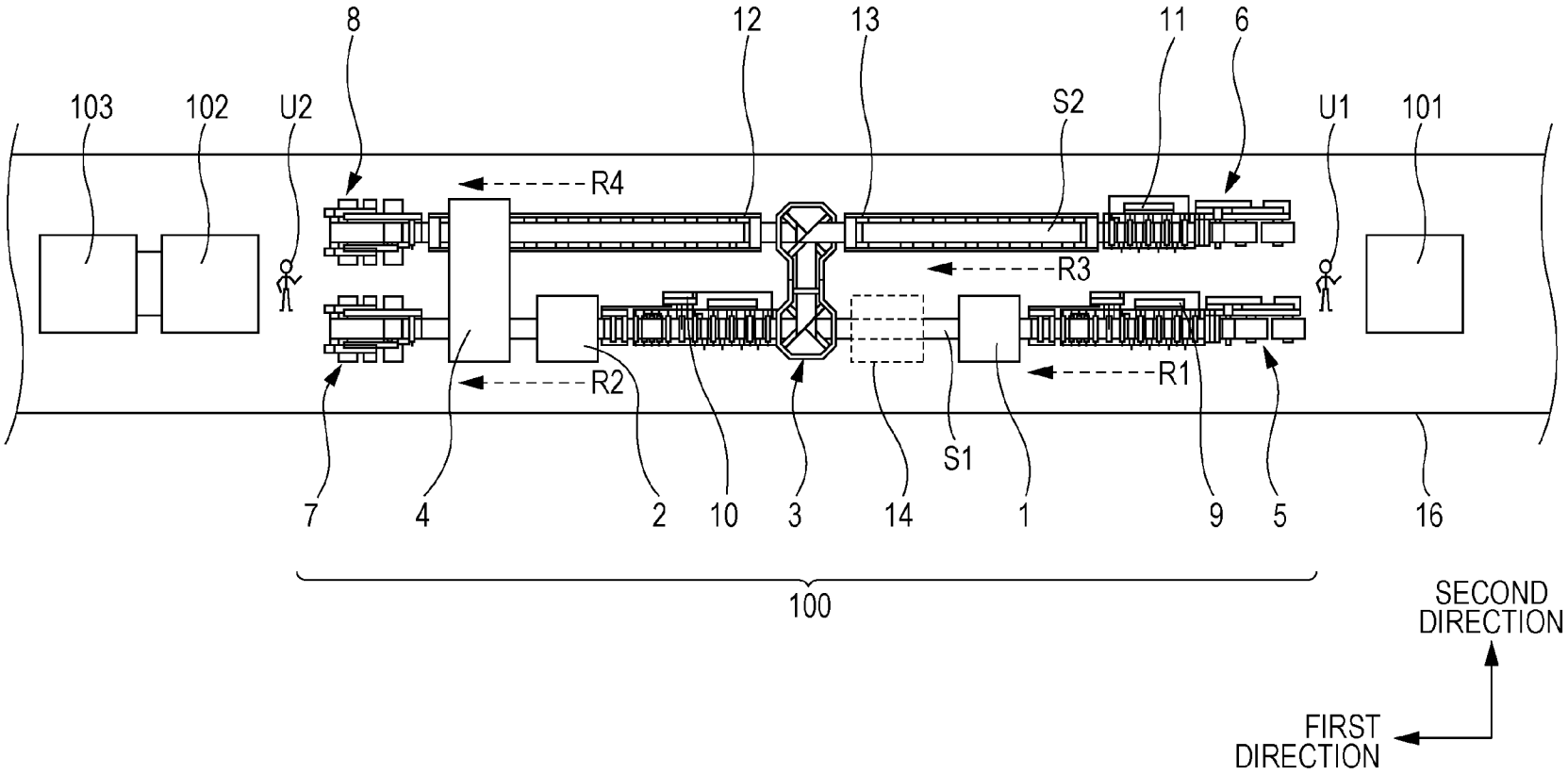
FIG. 1 is an overall perspective view of a printing system according to an embodiment.

FIG. 1 is an overall perspective view of a printing system according to an embodiment of the present invention. A straight path including a path R1 and a path R2 is referred to as a first path, while a straight path including a path R3 and a path R4 is referred to as a second path. The first path and the second path are parallel to each other and substantially identical in overall length. In the present specification, the term "parallel" refers not only to being exactly parallel, but also refers to being substantially parallel with a small difference in direction. In a plane parallel to a floor, a direction of the first path and the second path is defined as a first direction (predetermined direction), and a direction orthogonal to the first direction is defined as a second direction. A plane parallel to the floor and including the first direction and the second direction is referred to as a predetermined plane.

Processing devices configured to perform an exemplary printing process are laid out on a floor 16 of a printing facility. The process includes a line of sequential processing performed in the first direction by a printing system 100 that performs print processing on continuous sheets, a pre-processing apparatus 101 for pre-processing before a printing step, and post-processing apparatuses (a sheet cutting apparatus 102 and a bookbinding apparatus 103) for post-processing after the printing step. Printing apparatuses of the present embodiment use a continuous sheet wound in a roll. The printing apparatuses are capable of selectively performing duplex printing on a first side and a second side opposite the first side of the sheet, and simplex printing on one side of the sheet.

Main components of the printing system 100 are two printing apparatuses which are a first printing apparatus 1 (first processing apparatus) and a second printing apparatus (second processing apparatus), a path switching unit 3 (switching unit), and a drying apparatus 4. Both the first printing apparatus 1 and the second printing apparatus 2 print on one side (upper side in FIG. 1) of a sheet. The printing apparatuses adopt an inkjet method as a printing method. Examples of adoptable methods include those using a heating element, a piezoelectric element, an electrostatic element, and an MEMS element. The present invention is applicable not only to inkjet printing apparatuses, but also to printing apparatuses using various printing methods, such as electrophotographic printers, thermal printers (dye-sublimation printers, thermal transfer printers, etc.), dot impact printers, and liquid development printers.

The printing system 100 carries out processing simultaneously in two lines. Therefore, two different lines are provided for each of a loading (input) operation and an unloading (output) operation. For the loading operation, there are provided two lines in which a first input unit 5 and a second input unit 6 are located within a loading area. The first input unit 5 is for introducing and feeding a first continuous sheet S1 to the first printing apparatus 1 in the first direction. The second input unit 6 is for introducing and feeding a second continuous sheet S2 to the second printing apparatus 2 also in the first direction. The second input unit 6 is disposed adjacent to the first input unit 5. In the first input unit 5, an unused roll formed by winding a continuous sheet on a sheet holder is loaded such that the sheet is introduced along a path as the roll rotates. In the second input unit 6, an unused roll formed by winding a continuous sheet on a sheet holder is loaded such that the sheet is introduced along a path as the roll rotates. The sheet is not limited to that wound in a roll, as long as it is a continuous sheet. For example, a continuous sheet perforated at regular intervals may be folded at each perforation line, stacked, and held in a sheet holder.

Both the first input unit 5 and the second input unit 6 are configured to introduce a sheet in the first direction. However, as described above, the first input unit 5 and the second input unit 6 may not be exactly parallel, and may be slightly different in direction. Also, the first input unit 5 and the second input unit 6 may not be arranged adjacent to each other at the same position in the first direction. As long as both the first input unit 5 and the second input unit 6 introduce a sheet in the first direction, they may be laid out closely but at different positions in the first direction.

As for the unloading operation, there are provided two lines in which a first output unit 7 and a second output unit 8 are located within an unloading area. The second output unit 8 is disposed adjacent to the first output unit 7. A continuous sheet printed by the second printing apparatus 2 and conveyed in the first direction is output to the first output unit 7. A continuous sheet printed by the first printing apparatus 1 and conveyed in the first direction is output to the second output unit 8. In the first output unit 7, a printed continuous sheet is wound on a sheet holder (winder) and output as a roll. In the second output unit 8, a printed continuous sheet is wound on a sheet holder (winder) and output as a roll. Alternatively, in each output unit, a sheet may not be output in a roll form, and may be cut by a cutter into cut sheets of predetermined length and output one by one to form a sheet stack.

Sheets are output to the first output unit 7 and the second output unit 8 both in the first direction. However, as described above, the first output unit 7 and the second output unit 8 may not be exactly parallel, and may be slightly different in direction. Also, the first output unit 7 and the second output unit 8 may not be arranged adjacent to each other at the same position in the first direction. The first output unit 7 and the second output unit 8 may be laid out closely but at different positions in the first direction. Although the two input units are close to each other, the two output units may not be closely laid out and may output sheets in different directions. Alternatively, although the two output units are close to each other, the two input units may not be closely laid out and may introduce sheets in different directions. The present invention broadly includes these configurations.

From the first input unit 5, the continuous sheet S1 is fed out by a conveying mechanism 9 along the path R1 and introduced into the first printing apparatus 1. From the second input unit 6, the continuous sheet S2 is fed out by a conveying mechanism 11 along the path R3, conveyed by a conveying mechanism 13, and introduced into the path switching unit 3. From the path switching unit 3, a sheet is conveyed by a conveying mechanism 10 along the path R2, and introduced into the second printing apparatus 2 and further into the drying apparatus 4. Also from the path switching unit 3, a sheet is conveyed by a conveying mechanism 12 along the path R4 and introduced into the drying apparatus 4.

The drying apparatus 4, which is disposed between the second printing apparatus 2 and the first output unit 7, dries a continuous sheet before the continuous sheet is output to the first output unit 7. The drying apparatus 4 also dries a continuous sheet before the continuous sheet is output to the second output unit 8. This means that the drying apparatus 4 is common to the first path (defined by paths R1 and R2) and the second path (defined by paths R3 and R4). An optional drying apparatus 14 specifically designed for the first printing apparatus 1 may be provided immediately after the first printing apparatus 1, and the drying apparatus 4 may be provided as one specifically designed for the second printing apparatus 2.

Sheets are introduced from the path R1 and the path R3 into the path switching unit 3 and led to the path R2 and the path R4. The path switching unit 3 is capable of switching the sheet travel path between the first path including the path R1 and the path R2 and the second path including the path R3 and the path R4. When a sheet travels from the path R1 to the path R2 along the first path, the path switching unit 3 can reverse the sheet. That is, the path switching unit 3 serves as a sheet-path switching apparatus for continuous sheets in two lines.

Figure 2:
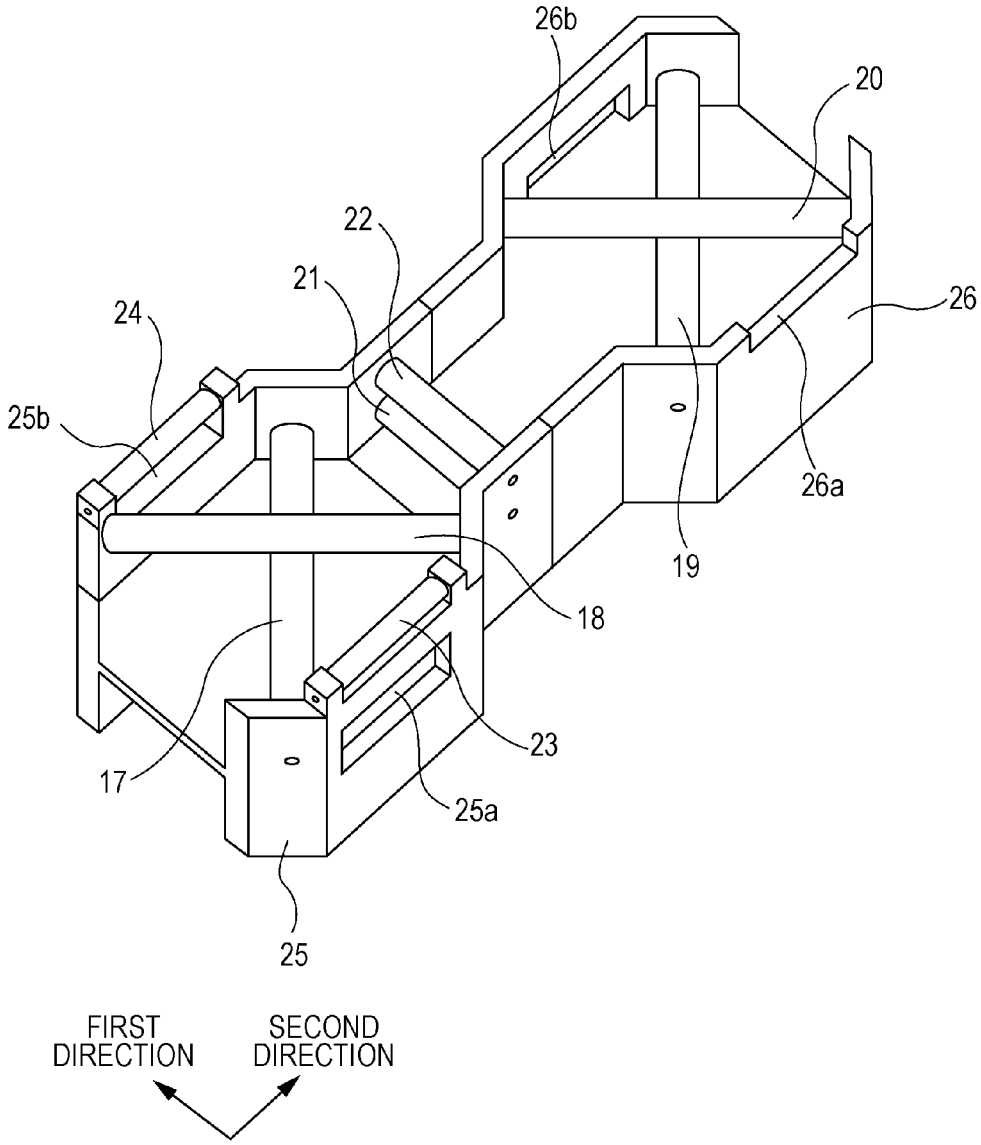
FIG. 2 is an enlarged view of a path switching unit illustrated in FIG. 1.

FIG. 2 is an enlarged perspective view of the path switching unit 3. The path switching unit 3 has a configuration which combines two units. A first unit (on the front side in FIG. 2) is provided on the first path and a second unit (on the back side in FIG. 2) is provided on the second path.

A structure of the path switching unit 3 will now be more specifically described. The first unit includes a first turn bar 17, a second turn bar 21, and a third turn bar 18 as basic components. These turn bars are collectively referred to as a first turn bar group. The first unit further includes an input-side roller 23 and an output-side roller 24 serving as auxiliary driven rollers, and a fourth turn bar 22 parallel and opposite to the second turn bar 21. Each of the turn bars and rollers of the first unit described above is rotatably held by a frame 25 (first support unit). The first turn bar 17 is a driven roller having a rotation axis that is inclined, in the predetermined plane, 45 degrees from the first direction (predetermined direction) in which a sheet is introduced. The third turn bar 18 is a driven roller having a rotation axis that is inclined, in the predetermined plane, −45 degrees from the first direction. A sheet introduced is obliquely wound a half turn around the third turn bar 18 and folded, so that the direction of travel of the sheet is changed 90 degrees between the first direction and the second direction. The second turn bar 21 and the fourth turn bar 22 are driven rollers each having a rotation axis parallel to the first direction. A sheet is wound straight a half turn around the pair of the second turn bar 21 and the fourth turn bar 22, so that the direction of travel of the sheet is changed 180 degrees. Note that each of the angles described above is a central value within a small margin of tolerance.

The second unit includes a fifth turn bar 19 and a sixth turn bar 20 as basic components. Each of these turn bars is rotatably held by a frame 26 (second support unit). The fifth turn bar 19 is a driven roller having a rotation axis that is inclined, in the predetermined plane, 45 degrees from the first direction. The sixth turn bar 20 is a driven roller having a rotation axis that is inclined, in the predetermined plane, −45 degrees from the first direction. The frame 25 and the frame 26 are integrally combined together. Alternatively, the frame 25 and the frame 26 may not be combined together, and the first unit and the second unit may be configured as separate parts. In the first direction, walls of the frame 25 are provided with openings 25*a* and 25*b* which allow a sheet to pass therethrough. In the first direction, walls of the frame 26 are also provided with openings 26*a* and 26*b* which allow a sheet to pass therethrough. There is no wall between the frame 25 and the frame 26, so that a sheet can freely pass therebetween.

Figure 3:
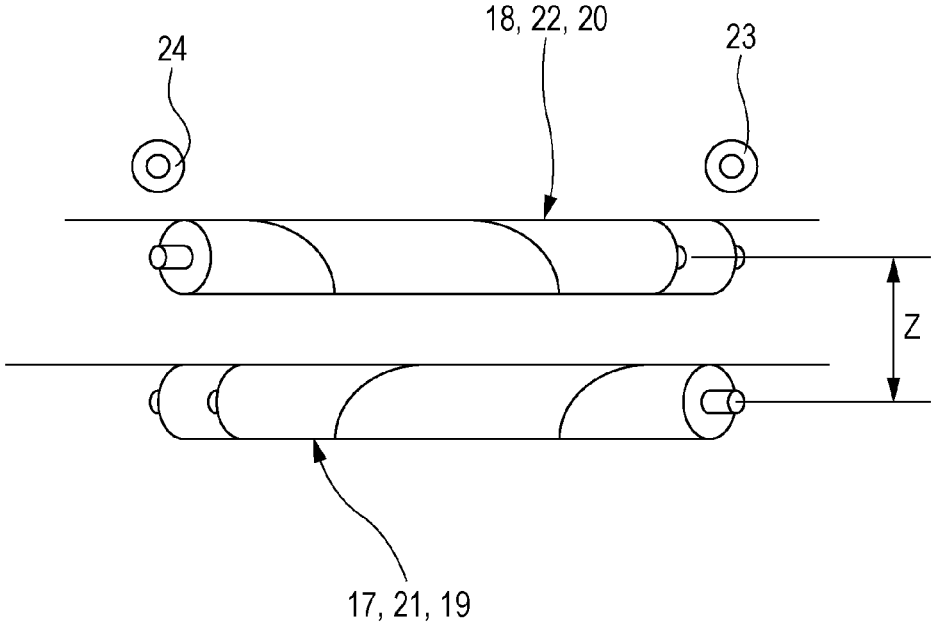
FIG. 3 illustrates a relationship between heights of turn bars.

FIG. 3 is a diagram illustrating the path switching unit 3 as viewed in the second direction in FIG. 2. FIG. 3 illustrates a relationship between heights of the turn bars. The first turn bar 17, the second turn bar 21, and the fifth turn bar 19 (first set) are arranged such that they are at substantially the same height. The third turn bar 18, the fourth turn bar 22, and the sixth turn bar 20 (second set) are arranged such that they are at substantially the same height. The first set and the second set are different in height with a gap Z therebetween. The second set is positioned at a level higher than the first set. The roller 23 and the roller 24 are positioned at a level higher than the second set.

The first turn bar 17 to the sixth turn bar 20 each are a contact turn bar rotated by coming into contact with a sheet wound around its roller surface. Alternatively, some or all of the turn bars may be non-contact turn bars each having a non-contact static pressure surface. The non-contact static pressure surface is configured to support a sheet in a non-contact manner while allowing it to float at micro-intervals by blowing air thereto. The static pressure surface is, for example, a porous surface that blows air from pores to allow a sheet to float with static pressure or with static and dynamic pressure. The non-contact turn bars are secured or rotatably supported in the path switching unit 3. The non-contact turn bars may not have a roller shape, as they do not necessarily need to be rotated. The non-contact turn bars may be of any shape, as long as a portion opposite a sheet (i.e., a portion facing and supporting a sheet in a non-contact manner) has a static pressure surface with a predetermined curvature. Regardless of whether the turn bar is of contact or non-contact type, the turn bar is configured to change the direction of travel of a continuous sheet that is wound around its surface.

Next, a pre-processing apparatus for pre-processing before a printing step, and post-processing apparatuses for post-processing after the printing step will be described. As the pre-processing apparatus 101 illustrated in FIG. 1, a pre-coating apparatus is provided upstream of the first input unit 5 and the second input unit 6 of the printing system 100. The pre-coating apparatus applies a pre-coating to one or both sides of a sheet, before printing, to improve smoothness and glossiness of the sheet surface. A sheet pre-processed by the pre-processing apparatus 101 is output as a roll. The roll is carried by a worker U1 and loaded into one of the first input unit 5 and the second input unit 6. The first input unit 5 and the second input unit 6 are adjacent to each other and close in distance from the pre-processing apparatus 101. When loading a roll into either of the input units, the worker U1 does not need to move a long distance from the pre-processing apparatus 101. Since a work space for the worker U1 to load a sheet into the printing system 100 is a single work space, the total floor area can be saved and high work efficiency of the worker U1 can be achieved. Moreover, since a distance that the worker U1 carries a roll from the pre-processing apparatus 101 into either of the first input unit 5 and the second input unit 6 is short, the workload placed on the worker U1 is minimized. Additionally, since a roll can be loaded into both the first input unit 5 and the second input unit 6 in the same direction, the worker U1 is not confused when loading the roll into either of the input units.

As post-processing apparatuses, the sheet cutting apparatus 102 and the bookbinding apparatus 103 downstream of the sheet cutting apparatus 102 are provided downstream of the first output unit 7 and the second output unit 8 of the printing system 100. A roll in the first output unit 7 or the second output unit 8 is carried by a worker U2 and loaded into the sheet cutting apparatus 102. A printed roll is cut into pieces of predetermined length by the sheet cutting apparatus 102 and output to a plurality of trays on a lot-by-lot basis. The cut sheets may be further conveyed to the bookbinding apparatus 103 downstream of the sheet cutting apparatus 102 and bookbound. The bookbinding apparatus 103 performs folding and binding. The cut sheets output from the sheet cutting apparatus 102 are conveyed to the bookbinding apparatus 103, folded, bound, and output as a finished product.

Rolls output to the first output unit 7 and the second output unit 8 of the printing system 100 are carried by a worker U2 and loaded into the sheet cutting apparatus 102. The first output unit 7 and the second output unit 8 are adjacent to each other and close in distance to the sheet cutting apparatus 102. When unloading a roll from either of the output units, the worker U2 does not need to move a long distance to the sheet cutting apparatus 102. Since a work space for the worker U2 to unload a sheet from the printing system 100 is a single work space, the total floor area can be saved and high work efficiency of the worker U2 can be achieved. Moreover, since a distance that the worker U2 carries a roll to the sheet cutting apparatus 102 from either of the first output unit 7 and the second output unit 8 is short, a workload placed on the worker U2 is small. Additionally, since a roll can be held in both the first output unit 7 and the second output unit 8 in the same direction, the worker U2 is not confused when unloading the roll from either of the output units. The pre-processing and post-processing apparatuses are not limited to those described above, and may be any types of processing apparatuses.

Figure 10:
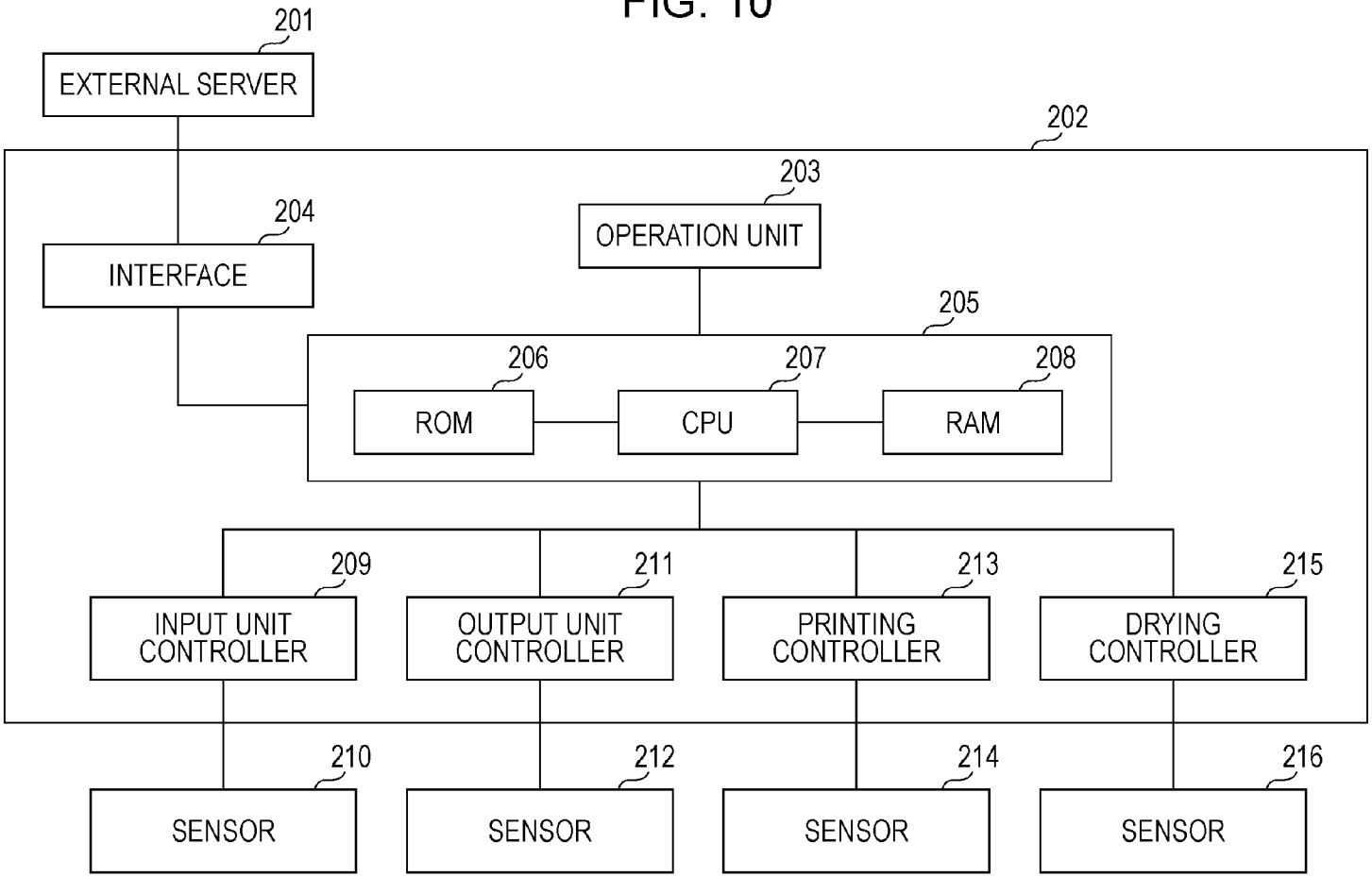
FIG. 10 is a block diagram illustrating a control unit for the printing system.

FIG. 10 is a block diagram illustrating a control system for the printing system 100. A control apparatus 202 controls the operation of the first printing apparatus 1 and the second printing apparatus 2. The control apparatus 202 includes an operation unit 203, an interface 204, and a controller 205. The controller 205 includes a CPU 207, a ROM 206, and a RAM 208. The operation unit 203 includes keys and buttons for a worker to input information, and an indicator that displays information to the worker. The controller 205 is connected via the interface 204 to an external server 201. The external server 201 is a computer that generates and processes image data to be printed, or a special-purpose image input device, such as an image reader, a digital camera, or a photo storage device. The control apparatus 202 further includes special-purpose controllers that control respective units constituting the printing system 100. The special-purpose controllers include an input unit controller 209, an output unit controller 211, a printing controller 213, and a drying controller 215. Signals from various sensors 210, such as encoders for the first input unit 5 and the second input unit 6, are input to the input unit controller 209. Signals from various sensors 212, such as encoders for the first output unit 7 and the second output unit 8, are input to the output unit controller 211. Signals from various sensors 214 for the first printing apparatus 1 and the second printing apparatus 2 are input to the printing controller 213. Signals from various sensors 216 for the drying apparatus 4 are input to the drying controller 215. The controller 205 provides commands to these special-purpose controllers so as to control the overall operation of the printing system 100 of FIG. 1.

Next, operations in duplex printing mode (first printing mode) and simplex printing mode (second printing mode) in the printing system 100 will be described. After selecting one of the modes using the operation unit 203, the worker places a sheet as described below to start printing.

(Simplex Printing Mode)

First, simplex printing mode will be described. There are two types of simplex printing mode: double simplex-printing mode which allows the first printing apparatus 1 and the second printing apparatus 2 to be simultaneously operated in parallel, and single simplex-printing mode which allows only one of the printing apparatuses to be operated. A selection as to which mode is to be executed can be made by the worker using the operation unit 203.

In simplex printing, sheets are folded twice by two turn bars included in the first unit of the path switching unit 3 and two turn bars included in the second unit of the path switching unit 3, so that the paths along which the sheets travel are switched. These four turn bars are collectively referred to as a second turn bar group. Some turn bars (two turn bars) in the second turn bar group are common to some turn bars (two turn bars) in the first turn bar group. A sheet introduced from the path R1 passes through the path switching unit 3 and is led to the path R4. A sheet introduced from the path R3 passes through the path switching unit 3 and is led to the path R2.

Figure 4:
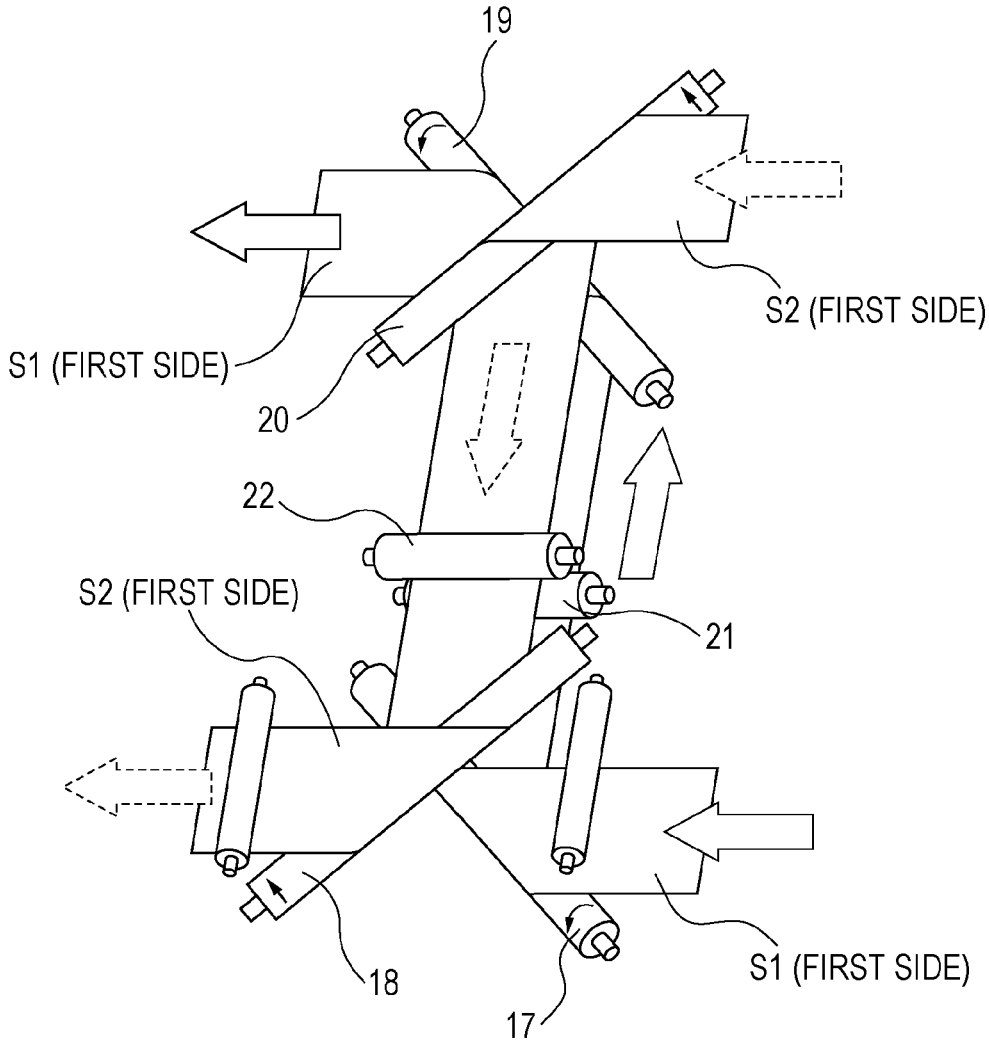
FIG. 4 illustrates a state of sheets that pass through the path switching unit in double simplex-printing mode.

FIG. 4 illustrates a state of sheets that pass through the path switching unit 3 in double simplex-printing mode. The sheets in two lines cross each other at different heights and do not come into contact with each other. Specifically, the first continuous sheet S1 introduced from the first input unit 5 in the path R1 and printed on one side (first side) by the first printing apparatus 1 is introduced into the first unit of the path switching unit 3. The continuous sheet S1 is obliquely wound a half turn downward around the first turn bar 17, diverted from the first direction to the second direction, and passes under the second turn bar 21. Then, the continuous sheet S1 is obliquely wound a half turn upward around the fifth turn bar 19, diverted from the second direction to the first direction, and led to the path R4. The sheet is folded twice (an even number of times) by the turn bars and reversed also twice. Therefore, a printed side of the sheet is eventually not reversed by the path switching unit 3, and only switching of the path from the first path to the second path is made. After being led to the path R4, the sheet is dried by the drying apparatus 4 and output to the second output unit 8.

On the other hand, the second continuous sheet S2 introduced from the second input unit 6 is introduced into the second unit of the path switching unit 3. The continuous sheet S2 is obliquely wound a half turn downward around the sixth turn bar 20, diverted from the first direction to the second direction, and passes under the fourth turn bar 22 (i.e., between the fourth turn bar 22 and the second turn bar 21). Then, the continuous sheet S2 is obliquely wound a half turn upward around the third turn bar 18, diverted from the second direction to the first direction, and led to the path R2. The sheet is folded twice (an even number of times) by the turn bars and reversed also twice. Therefore, a side of the sheet is eventually not reversed by the path switching unit 3, and only switching of the path from the second path to the first path is made. In the path R2, the continuous sheet S2 is printed on one side (first side) by the second printing apparatus 2, dried by the drying apparatus 4, and output to the first output unit 7. As described above, the continuous sheet S1 and the continuous sheet S2 pass through the path switching unit 3 at different heights in opposite directions, so that they are prevented from coming into contact with each other within the apparatus.

Thus, when the continuous sheet S1 printed on the first side by the first printing apparatus 1 is wound around the first turn bar 17 and the fifth turn bar 19, the second side (which is an entirely non-printed side) of the continuous sheet S1 faces the surfaces of the turn bars. The printed first side of the continuous sheet S1 does not face the surface of either of the turn bars. The continuous sheet S1 passes through the path switching unit 3 immediately after being printed by the first printing apparatus 1. Since the continuous sheet S1 has not yet passed through the drying apparatus 4, ink on the continuous sheet S1 has not been fully dried. This means that if the printed side of the continuous sheet S1 comes into contact with either of the turn bars, dust from the turn bar may adhere to the printed side, or ink may be transferred to the turn bar and may adversely affect the printed image. Even when a non-contact turn bar, which does not come into contact with the printed side, is used as described above, air blown from the turn bar surface to the printed side immediately after printing may change the dried state and cause color unevenness. When the sheet is passed in the manner described in this example, since the printed side does not face any turn bar surface, the printed image can be prevented from being adversely affected by contact of the turn bar with the printed side or by air blown from the static pressure surface. As for the continuous sheet S2, which is printed by the second printing apparatus 2 after passing through the path switching unit 3, a side to be printed does not come into contact with anything. Therefore, the side to be printed can avoid scratches and adherence of dust before printing.

Figure 5:
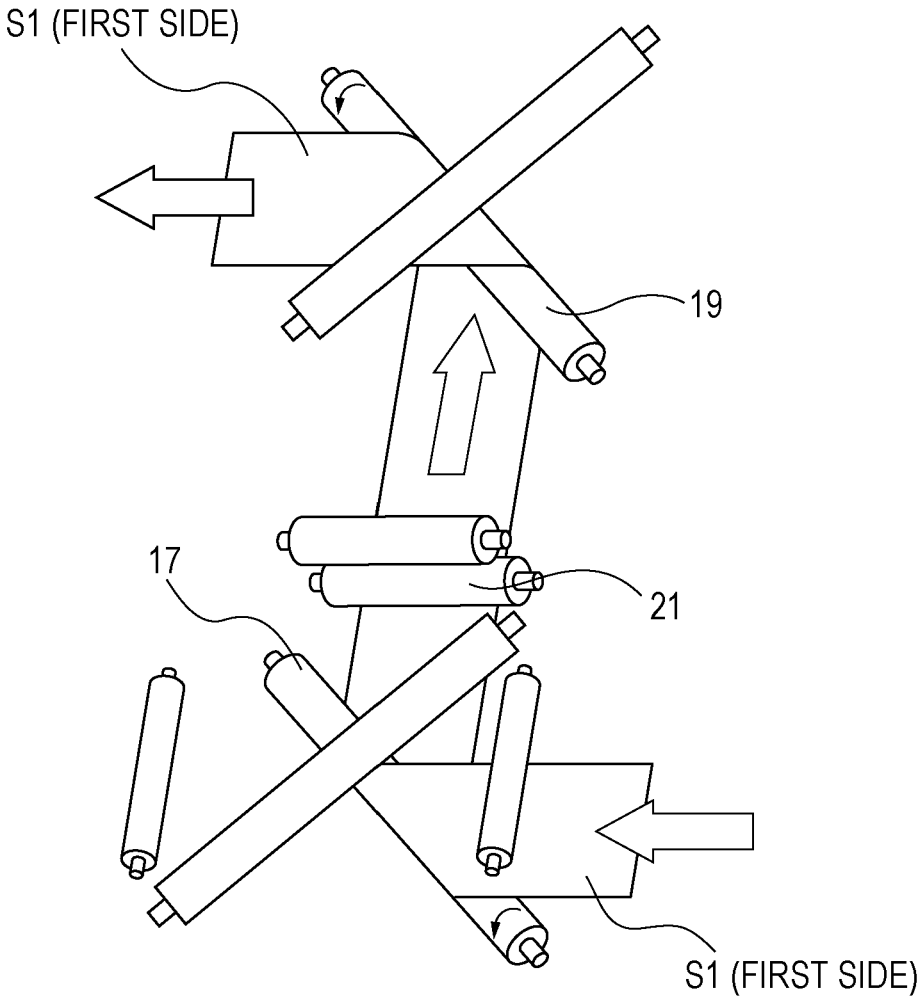
FIG. 5 illustrates a state of a sheet that passes through the path switching unit in single simplex-printing mode.

FIG. 5 illustrates a state of a sheet that passes through the path switching unit 3 in single simplex-printing mode which allows only the first printing apparatus 1 to be operated. In FIG. 5, only components with which the sheet is in contact or to which the sheet is close, in the path switching unit 3, are given reference numerals. The continuous sheet S1 is obliquely wound a half turn downward around the first turn bar 17, diverted from the first direction to the second direction, and passes under the second turn bar 21. Then, the continuous sheet S1 is obliquely wound a half turn upward around the fifth turn bar 19, diverted from the second direction to the first direction, and led to the path R4.

Figure 6:
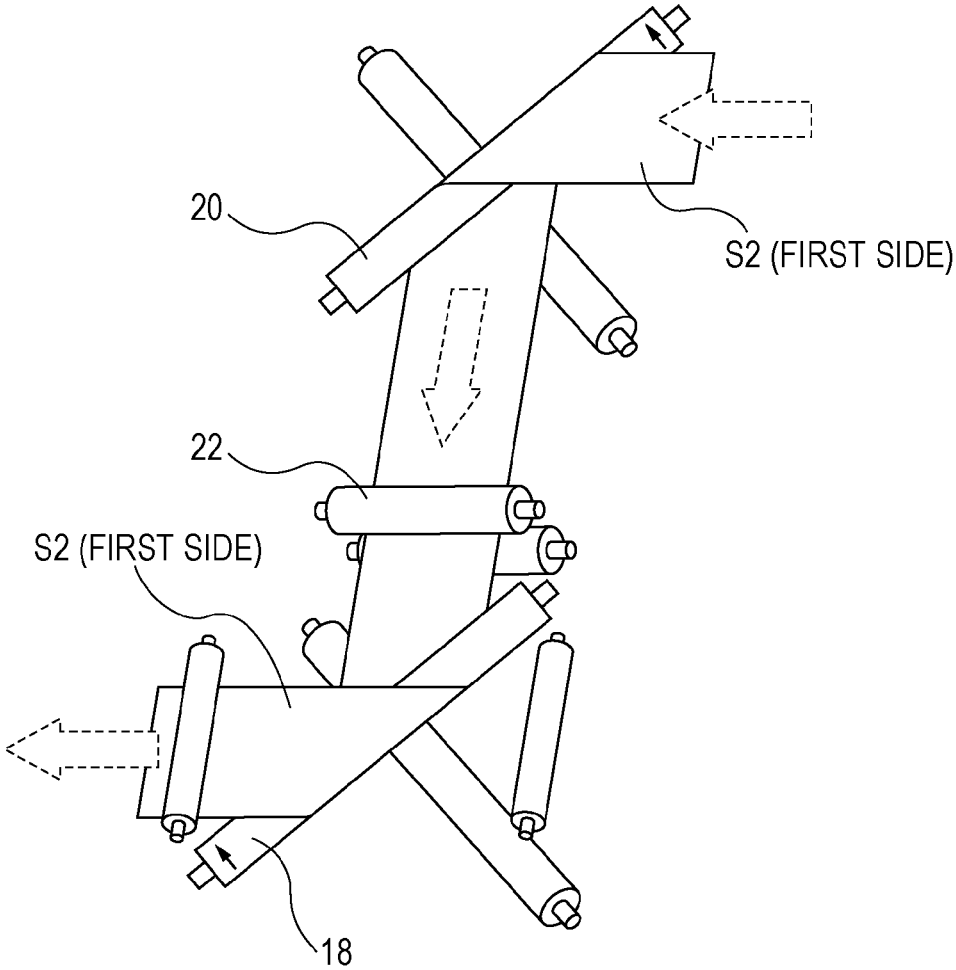
FIG. 6 illustrates a state of a sheet that passes through the path switching unit in single simplex-printing mode.

FIG. 6 illustrates a state of a sheet that passes through the path switching unit 3 in single simplex-printing mode which allows only the second printing apparatus 2 to be operated. In FIG. 6, only components with which the sheet is in contact or to which the sheet is close, in the path switching unit 3, are given reference numerals. The continuous sheet S2 is obliquely wound a half turn downward around the sixth turn bar 20, diverted from the first direction to the second direction, and passes under the fourth turn bar 22. Then, the continuous sheet S2 is obliquely wound a half turn upward around the third turn bar 18, diverted from the second direction to the first direction, and led to the path R2.

(Duplex Printing Mode)

Next, duplex printing mode will be described. Duplex printing mode allows the first printing apparatus 1 and the second printing apparatus 2 to be operated in series to sequentially print on front and back sides of a sheet. In duplex printing, a sheet S1 introduced from the path R1 is folded three times by three turn bars (first turn bar group) included in the first unit, so that the first and second sides of the sheet S1 are reversed before the sheet is led to the path R2.

Figure 7:
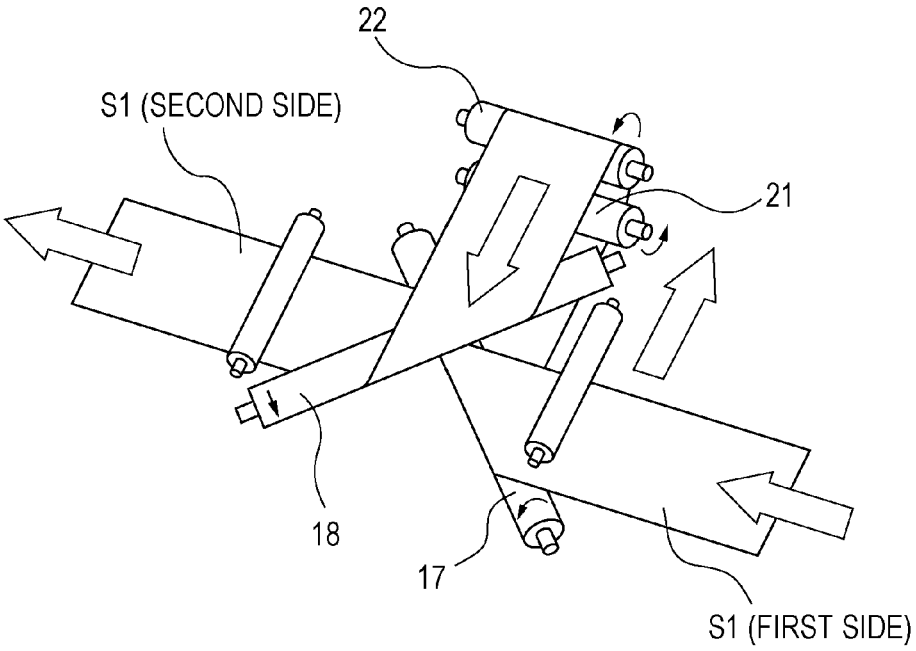
FIG. 7 illustrates a state of a sheet that passes through the path switching unit in duplex printing mode.

FIG. 7 illustrates a state of a sheet that passes through the path switching unit 3 in duplex printing mode which allows the first printing apparatus 1 and the second printing apparatus 2 to be operated. In FIG. 7, only components with which the sheet is in contact or to which the sheet is close, in the path switching unit 3, are given reference numerals. In the path R1, the continuous sheet S1 introduced from the first input unit 5 and printed on one side (first side) by the first printing apparatus 1 is introduced into the first unit of the path switching unit 3. The continuous sheet S1 is obliquely wound a half turn downward around the first turn bar 17, and diverted from the first direction to the second direction. Then, the continuous sheet S1 is wound straight a half turn upward around the pair of the second turn bar 21 and the fourth turn bar 22 and diverted 180 degrees. For this operation, the fourth turn bar 22 can be removed, as it merely serves as an auxiliary turn bar. In this case, the continuous sheet S1 is wound only around the second turn bar 21, so that the direction of travel of the sheet is reversed. Next, the continuous sheet S1 is obliquely wound a half turn downward around the third turn bar 18, diverted from the second direction to the first direction, and led to the path R2. In the path switching unit 3, the sheet is folded three times (an odd number of times) by the turn bars and reversed also three times. Therefore, the first and second sides of the sheet S1 are effectively reversed by the path switching unit 3. In the path R2, the continuous sheet S2 is printed on the second side by the second printing apparatus 2, dried on both sides by the drying apparatus 4, and output to the first output unit 7.

Thus, when the continuous sheet S1 printed on the first side by the first printing apparatus 1 is wound around the first turn bar 17, the second turn bar 21, and the third turn bar 18, the second side (which is an entirely non-printed side) of the continuous sheet S1 faces the surfaces of the turn bars. The printed first side of the continuous sheet S1 does not face the surface of any turn bar. Therefore, the printed side can be prevented from being adversely affected.

(Two-Time Simplex-Printing Mode)

Figure 8:
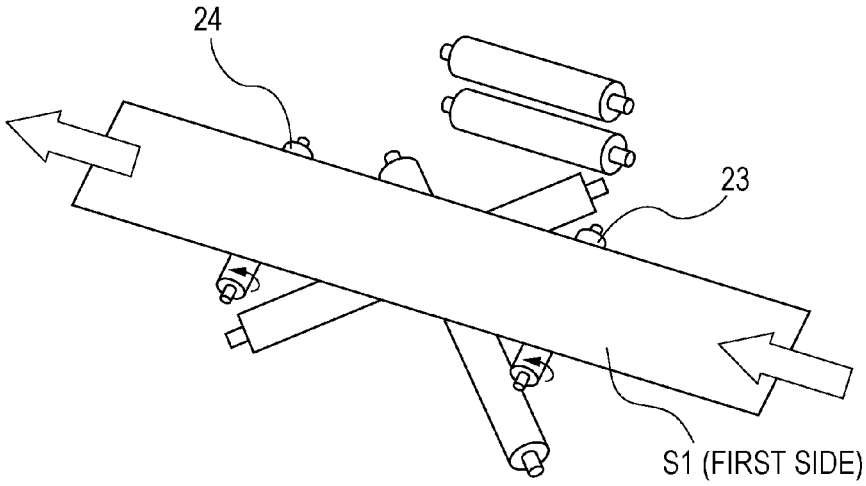
FIG. 8 illustrates a state of a sheet that passes through the path switching unit in two-time simplex-printing mode.

The printing system 100 is capable of executing two-time simplex-printing mode, as well as simplex printing mode and duplex printing mode described above. FIG. 8 illustrates a state of a sheet that passes through the path switching unit 3 in two-time simplex-printing mode which allows both the first printing apparatus 1 and the second printing apparatus 2 to be operated. In FIG. 8, only components with which the sheet is in contact or to which the sheet is close, in the path switching unit 3, are given reference numerals.

Two-time simplex-printing mode allows the first printing apparatus 1 and the second printing apparatus 2 to be operated in series to sequentially print on one and the same side (first side) of a sheet. Specifically, a continuous sheet S1 fed from the first input unit 5 is printed on the first side by the first printing apparatus 1 and travels straight along the first path without being reversed by the path switching unit 3. In the path switching unit 3, the sheet passes over the roller 23 and the roller 24 while being guided on the second side by each of the rollers. Since the printed first side does not come into contact with the surface of either of the rollers, the printed side can be prevented from being adversely affected. After passing through the switching unit 3, the continuous sheet S1 is printed again on the same side (first side) by the second printing apparatus 2. Then, after being printed on the first side by the second printing apparatus 2, the continuous sheet passes through the drying apparatus 4 and is output to the first output unit 7.

In two-time simplex-printing mode, when inks of different colors are applied to a sheet by the two printing apparatuses, it is possible to double the total number of colors while maintaining the printing speed. A further improvement in image quality can thus be achieved. Moreover, when a print side of the sheet is spatially divided into very small sections and printed by the two printing apparatuses in a synchronized manner, the sheet conveyance speed can be doubled to maximize efficiency. Printing throughput is thus improved.

(Line Addition)

Figure 9:
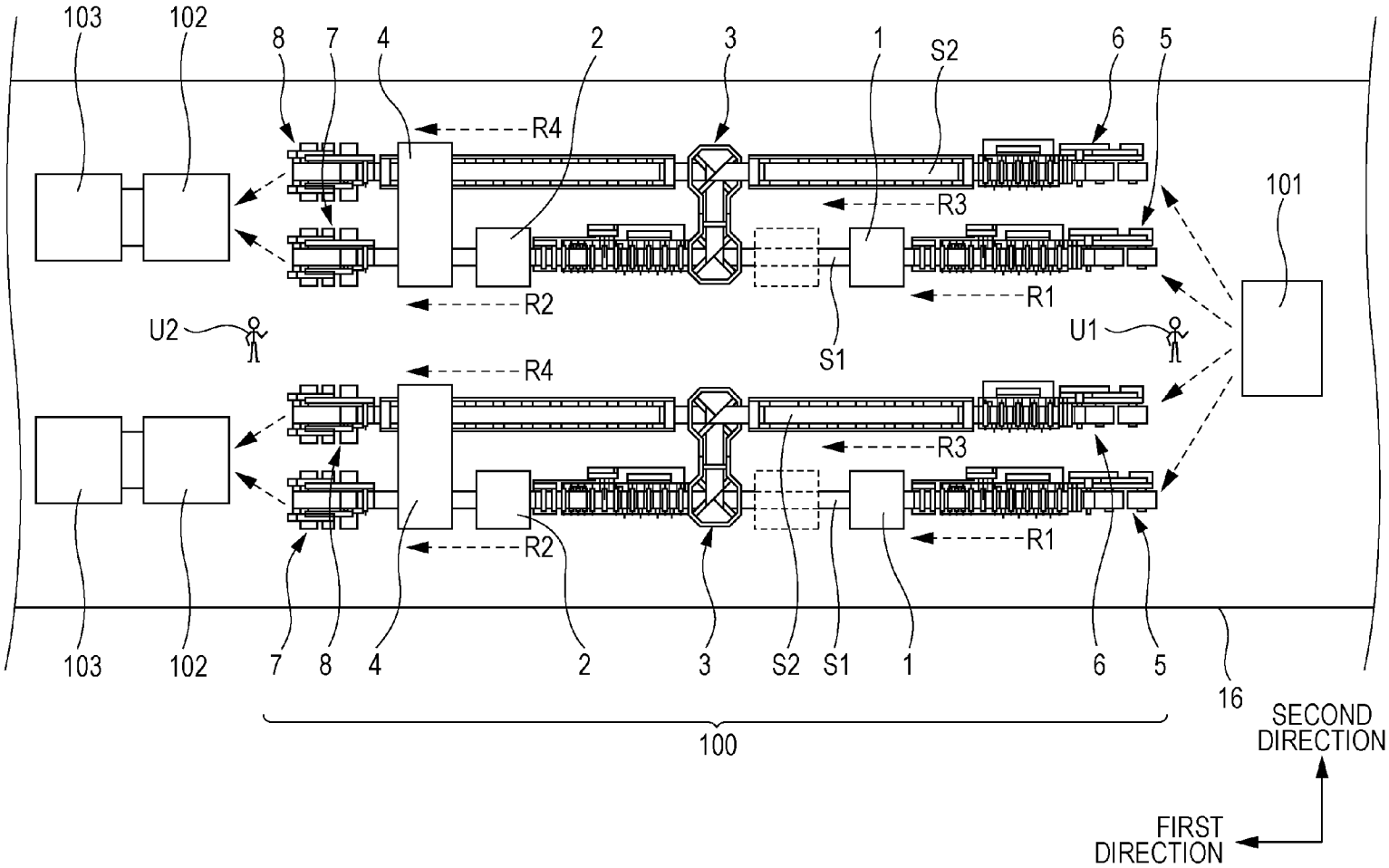
FIG. 9 is an overall perspective view of the printing system in which printing lines are added.

Printing lines can be easily added in the printing system 100 serving as a single unit. FIG. 9 is a top view of an overall configuration including added printing lines. As illustrated, two additional printing lines identical to those described above with reference to FIG. 1 are arranged in parallel. This means that the entire printing system 100 now includes a total of four lines composed of two sets of two lines. A combination of duplex printing mode, single simplex-printing mode, and double simplex-printing mode in these lines can be determined appropriately depending on the worker's purpose of use.

Although two drying apparatuses 4 are provided here, one drying apparatus common to the four lines may be provided. Although one pre-processing apparatus 101 common to the four lines is provided here, two or four pre-processing apparatuses may be provided. Although one sheet cutting apparatus 102 and one bookbinding apparatus 103, which are post-processing apparatuses, are provided for every two lines, they may be common to the four lines or may be provided for each line.

As described above, due to the simplicity of the linear arrangement of the printing system 100, addition of processing lines can be easily made. Moreover, to optimize worker efficiency with the line addition, input units are gathered in the same place and output units are also gathered in the same place. Specifically, as illustrated in FIG. 9, in the printing system 100 after the line addition, four input units are located adjacent to each other in the same place (i.e., within a common inputting area accessible to a worker U1), and four output units are also located adjacent to each other in the same place (i.e., within a common outputting area accessible to a worker U2). This means that a work space for the worker U1 to load sheets into the printing system 100 is a single space, and a work space for the worker U2 to unload sheets from the printing system 100 is also a single space. Thus, the total floor area can be saved and high work efficiency of both the worker U1 and the worker U2 can be achieved.

In the embodiments described above, it is possible to flexibly accommodate addition of processing lines. Either in a basic unit or after line addition, input units are gathered in the same place and output units are also gathered in the same place. Therefore, the distance that rolls are carried from and to pre-processing and post-processing apparatuses is small and a workload placed on workers is small. Additionally, since only a small floor area is required in a factory for installation of processing lines, it is possible to realize a highly-integrated layout. Moreover, in any of duplex printing mode, simplex printing mode, and two-time simplex-printing mode, a printed side of a sheet does not face the surface of any turn bar when the sheet is folded by the path switching unit. Therefore, the printed side can be prevented from being adversely affected by contact with a contact turn bar or air blowing from a static pressure surface of a non-contact turn bar.

In the embodiments described above, an input unit is configured to introduce a continuous sheet. However, an input unit may be configured to continuously introduce a plurality of cut sheets of predetermined length obtained by cutting a sheet in advance. Alternatively, before being printed by a printing apparatus, a continuous sheet input to an input unit may be automatically cut into cut sheets by a cutter, so that the cut sheets can be printed and output. In such configurations, each line is provided with a conveying mechanism which includes a roller and a belt for conveying cut sheets one by one. At the same time, in the path switching unit 3, for allowing cut sheets to be automatically wound around predetermined turn bars and conveyed, each turn bar is configured as a roller pair having a driving force for nipping and conveying the sheets.

According to the present invention, since a roll carrying distance between a processing line and devices used in the preceding and subsequent steps is small, a workload placed on workers is small. Additionally, since a floor area required in a factory for installation of processing lines is small, a highly-integrated layout can be realized. Also, according to the present invention, it is possible to flexibly accommodate addition of processing lines. Moreover, when a sheet is folded by the path switching unit, since a print side of the sheet does not face any turn bar in either duplex or simplex printing mode, the print side can be prevented from being adversely affected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/055790, filed Mar. 31, 2010, which is hereby incorporated by reference herein in its entirety.

The invention claimed is:

1. A printing system capable of performing duplex printing and simplex printing, the printing system comprising:

a first printing apparatus and a second printing apparatus disposed along a first path;

a first input unit configured to introduce a sheet into the first path;

a second input unit, disposed near the first input unit, configured to introduce a sheet into a second path parallel to the first path;

a first output unit to which a sheet that has traveled along the first path is output;

a second output unit, disposed near the first output unit, to which a sheet that has traveled along the second path is output; and a switching unit having a plurality of turnbars, capable of switching a sheet travel path between the first path and the second path, and capable of reversing the sides of a sheet that passes along the first path, wherein the first printing apparatus and a second printing apparatus are disposed along the first path between the first input unit and the first output unit, and no printing apparatus is disposed along the second path between the second input unit and the second output unit, wherein in the duplex printing, a sheet introduced from the first input unit into the first path is printed on a first side by the first printing apparatus, reversed at the switching unit by being turned three times with some of the turn bars, introduced into the second printing apparatus, printed on a second side reverse of the first side by the second printing apparatus, and output to the first output unit, wherein the first side having been printed does not contact each of the turn bars at the switching unit; and wherein, in the simplex printing, a first sheet introduced from the first input unit into the first path is printed by the first printing apparatus, diverted into the second path at the switching unit by being turned twice with some of the turn bars, and output to the second output unit, wherein the first side having been printed does not contact each of the turn bars at the switching unit, and a second sheet introduced from the second input unit into the second path is diverted into the first path at the switching unit by being turned twice with some of the turn bars, introduced into the second printing apparatus, printed by the second printing apparatus, and output to the first output unit, wherein the first sheet and the second sheet travel simultaneously in opposite directions at the switching unit.

2. The printing system according to claim 1, wherein the printing system is further capable of performing two-time simplex printing, in which the sheet introduced from the first input unit into the first path is printed on the first side by the first printing apparatus, introduced into the second printing apparatus without being reversed by the switching unit, printed on the first side by the second printing apparatus, and output to the first output unit.

3. The printing system according to claim 1, wherein the switching unit includes a first turn bar group and a second turn bar group, the first turn bar group and the second turn bar group having at least one turn bar in common; and wherein, in the duplex printing, a sheet is folded three times and reversed by the first turn bar group, and in the simplex printing, a sheet is folded twice and diverted by the second turn bar group.

4. The printing system according to claim 3, wherein the first turn bar group includes three turn bars, and wherein, in the duplex printing, the sheet is wound around the three turn bars such that the second side of the sheet faces surfaces of the three turn bars but the first side of the sheet does not face the surfaces of the three turn bars.

5. The printing system according to claim 4, wherein the second turn bar group includes four turn bars, two of the four turn bars are common to the first turn bar group and the second turn bar group; and wherein, in the simplex printing, when the sheet printed on the first side by the first printing apparatus is folded by a turn bar included in the second turn bar group, the second side of the sheet faces but the first side of the sheet does not face a surface of the turn bar included in the second turn bar group, and wherein, when the sheet introduced from the second input unit into the second path is folded by a turn bar included in the second turn bar group, the second side of the sheet faces but the first side of the sheet does not face a surface of the turn bar included in the second turn bar group.

6. The printing system according to claim 4, wherein the first turn bar group includes a first turn bar having a rotation axis that is inclined 45 degrees with respect to a predetermined direction in a predetermined plane, a second turn bar having a rotation axis that is parallel to the predetermined direction, and a third turn bar having a rotation axis that is inclined −45 degrees with respect to the predetermined direction in the predetermined plane;

wherein the second turn bar group includes a fifth turn bar having a rotation axis that is inclined 45 degrees with respect to the predetermined direction in the predetermined plane, and a sixth turn bar having a rotation axis that is inclined −45 degrees with respect the predetermined direction in the predetermined plane;

wherein, in the duplex printing, a sheet printed by the first printing apparatus and introduced into the switching unit is folded three times by being wound such that the second side faces a surface of the first turn bar, a surface of the second turn bar, and a surface of the third turn bar;

wherein, in the simplex printing, a sheet printed on the first side by the first printing apparatus and introduced into the switching unit is folded twice by being wound such that the second side faces the surface of the first turn bar and a surface of the fifth turn bar; and wherein a sheet introduced from the second input unit into the switching unit via the second path is folded twice by being wound such that the second side faces a surface of the sixth turn bar and the surface of the third turn bar.

7. The printing system according to claim 6, wherein the first turn bar, the second turn bar, and the third turn bar are rotatably held by a first support unit; the fifth turn bar and the sixth turn bar are rotatably held by a second support unit; and the first support unit and the second support unit are configured as an integral part or separate parts adjacent to each other.

8. The printing system according to claim 6, wherein as viewed in a direction crossing the predetermined direction in the predetermined plane, a set of the first turn bar, the second turn bar, and the fifth turn bar is disposed at a height different from a height of a set of the third turn bar and the sixth turn bar.

9. The printing system according claim 6, wherein the first turn bar group includes a fourth turn bar parallel to the second turn bar, and in the duplex printing, a sheet is wound around a pair of the second turn bar and the fourth turn bar.

10. The printing system according to claim 9, wherein in the simplex printing, a sheet is passed between the second turn bar and the fourth turn bar.

11. The printing system according claim 1, wherein the first printing apparatus and the second printing apparatus perform inkjet printing.

12. A sheet processing system capable of performing duplex processing and simplex processing, the sheet processing system comprising:

a first processing apparatus and a second processing apparatus disposed along a first path, each of the first and the second processing apparatuses performing at least a printing process;

a first input unit configured to introduce a sheet into the first path;

a second input unit configured to introduce a sheet into a second path parallel to the first path;

a first output unit to which a sheet that has traveled along the first path is output;

a second output unit to which a sheet that has traveled along the second path is output; and a switching unit having a plurality of turn bars, capable of switching a sheet travel path between the first path and the second path, and capable of reversing sides of a sheet that passes along the first path, wherein the first processing apparatus and a second processing apparatus are disposed along the first path between the first input unit and the first output unit, and no processing apparatus is disposed along the second path between the second input unit and the second output unit, wherein, in the duplex processing, a sheet introduced from the first input unit into the first path is processed on a first side by the first processing apparatus, reversed at the switching unit by being turned three times with some of the turn bars, introduced into the second processing apparatus, processed on a second side on the back side of the first side by the second processing apparatus, and output to the first output unit, wherein the first side having been processed by the first processing apparatus does not contact each of the turnbars at the switching unit; and wherein, in the simplex processing, a first sheet introduced from the first input unit into the first path is processed by the first processing apparatus, diverted into the second path at the switching unit by being turned twice with some of the turn bars, and output to the second output unit, wherein the first side having been processed by the first processing apparatus does not contact each of the bars at the switching unit, and a second sheet introduced from the second input unit into the second path is diverted into the first path at the switching unit by being turned twice with some of the bars, introduced into the second processing apparatus, processed by the second processing apparatus, and output to the first output unit, wherein the first sheet and the second sheet travel simultaneously in opposite directions at the switching unit.

* * * * *